US007874699B2

(12) United States Patent
Liang

(10) Patent No.: US 7,874,699 B2
(45) Date of Patent: Jan. 25, 2011

(54) HEAT DISSIPATING DEVICE FOR LED LIGHT-EMITTING MODULE

(75) Inventor: Chien-Kuo Liang, Chung-Ho (TW)

(73) Assignee: Aeon Lighting Technology Inc., Chung-Ho, Taipei County (TW)

( * ) Notice: Subject to any disclaimer, the term of this patent is extended or adjusted under 35 U.S.C. 154(b) by 872 days.

(21) Appl. No.: 11/822,433

(22) Filed: Jul. 5, 2007

(65) Prior Publication Data

US 2010/0186937 A1 Jul. 29, 2010

(51) Int. Cl.
*F21V 29/00* (2006.01)

(52) U.S. Cl. ..... 362/249.02; 362/294; 362/311.02; 362/373

(58) Field of Classification Search ..... 362/545, 362/249.02, 311.02, 547, 218, 294, 373
See application file for complete search history.

(56) References Cited

U.S. PATENT DOCUMENTS 6,787,999 B2 * 9/2004 Stimac et al. ..... 315/51
7,255,460 B2 * 8/2007 Lee ..... 362/294
7,303,301 B2 * 12/2007 Koren et al. ..... 362/101
2005/0174780 A1 * 8/2005 Park ..... 362/294
2007/0091597 A1 * 4/2007 Wang et al. ..... 362/231

* cited by examiner

*Primary Examiner*—Laura Tso
(74) *Attorney, Agent, or Firm*—Jackson IPG PLLC; Demian K. Jackson

(57) ABSTRACT

A heat dissipating device for LED light-emitting module, which embodies: A heat dissipating unit; An LED light-emitting module, in which light emitting diode are connected to a baseplate; A heat dissipating base; The heat dissipating base and the heat dissipating unit are mutually fixedly joined to form an integrated body, and the heat conducting layer is used to uniformly and efficiently transmit heat from the baseplate to the heat dissipating base, whereupon the heat dissipating base then transmits the heat to the heat dissipating unit. Accordingly, the quick and effective direct heat conduction of the heat conducting layer is used to conduct away and dissipate the high temperature produced by the LED, thereby extending serviceable life and improving stability and luminous efficiency of the LED, thus increasing heat dissipation efficiency of the entire LED light-emitting module.

8 Claims, 7 Drawing Sheets

HEAT DISSIPATING DEVICE FOR LED LIGHT-EMITTING MODULE

BACKGROUND OF THE INVENTION (a) Field of the Invention

The present invention provides a heat dissipating device for LED light-emitting module, and more particularly provides an LED light-emitting module that effectively increases heat dissipation efficiency.

(b) Description of the Prior Art

A typical example of an LED light-emitting module of prior art is disclosed in Taiwan patent number M297441, entitled "LED projection light source module", long term use of which leads to the appearance of the following defects:

1. Because the LED unit is in contact coordination within the holding space of the main body, thus, it is impossible for gaps not to appear in the interface between the two component members. For example, pores, machining tool marks and flatness leveling can be seen in the connecting contact surfaces when microscopically inspected. Hence, heat conduction efficiency of the LED unit to the main body is poor.

2. Because the main body is extruded and embedded within the through hole defined center of the heat dissipating unit, thus, the extrusion contact of the main body makes it difficult for the peripheral surface of the main body to be in complete linear contact with the contact surface of the heat dissipating unit, resulting in the production of microscopic pores, machining tool marks and flatness leveling on the peripheral surface of the main body, which cause the main body to be unable to effectively transmit heat to the fins. Moreover, if there is an inaccuracy in linear cross section of the fins in the through hole of the main body, for example, if only one of the fins is askew, then the linear cross section is unable to make effective contact with the peripheral surface of the main body, and efficiency of heat conduction is greatly affected.

3. Because the outer surface of the heat dissipating unit assembled from the plurality of radially arranged fins lacks any fixing device, thus, the entire assembly of fins is easily deformed if the heat dissipating unit is subjected to impact (such as falling to the ground), which can further cause a loose fit between the peripheral surface of the main body and linear cross section of a portion of the fins, leading to ineffective heat conduction.

4. When the LED unit is emitting light, there is no control of the transmission of light waves therefrom, and it is difficult for a designer to control lighting of the area being illuminated. For example, if it has been requested to provide focused light beams or dispersed light for an illuminated place, the LED unit does not provide for effective control of the emitted light.

In light of the aforementioned defects of prior art, subject of the present invention is to improve heat dissipation efficiency and heat dissipation stability of a LED light-emitting module.

SUMMARY OF THE INVENTION

A primary objective of the present invention is to provide a heat dissipating device for LED light-emitting module which uses a heat conducting layer bonded between a bottom surface of an LED light-emitting baseplate and a heat dissipating base to enable effectively conducting heat away from the LED light-emitting baseplate to the heat dissipating base, thereby improving heat dissipation efficiency of the LED light-emitting module.

Another objective of the present invention is to provide the heat dissipating device for LED light-emitting module with a heat dissipating unit provided with a cavity configured center thereof having a form corresponding with the heat dissipating base, wherein the cavity is provided with a linear cavity side wall and a linear horizontal cavity wall. A peripheral surface of the heat sink is soldered to the linear cavity side wall, and a bottom surface of the heat dissipating base is soldered to the linear horizontal cavity wall, thereby enabling the heat dissipating base to effectively and steadily conduct heat to the heat dissipating unit.

Yet another objective of the present invention is to provide the heat dissipating device for LED light-emitting module with an outer annular member joined to an outer peripheral edge of the heat dissipating unit, thereby increasing strength of the heat dissipating unit to endure external forces.

Yet another objective of the present invention is to increase the number of fins, thereby increasing heat dissipating area, and increasing area of contact between the heat dissipating fins and air to achieve better heat dissipation effectiveness. In addition, provide the heat dissipating device for LED light-emitting module with a lens connected to an upper portion of the LED light-emitting module to control focusing or defocusing of the light spectrum emitted therefrom.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
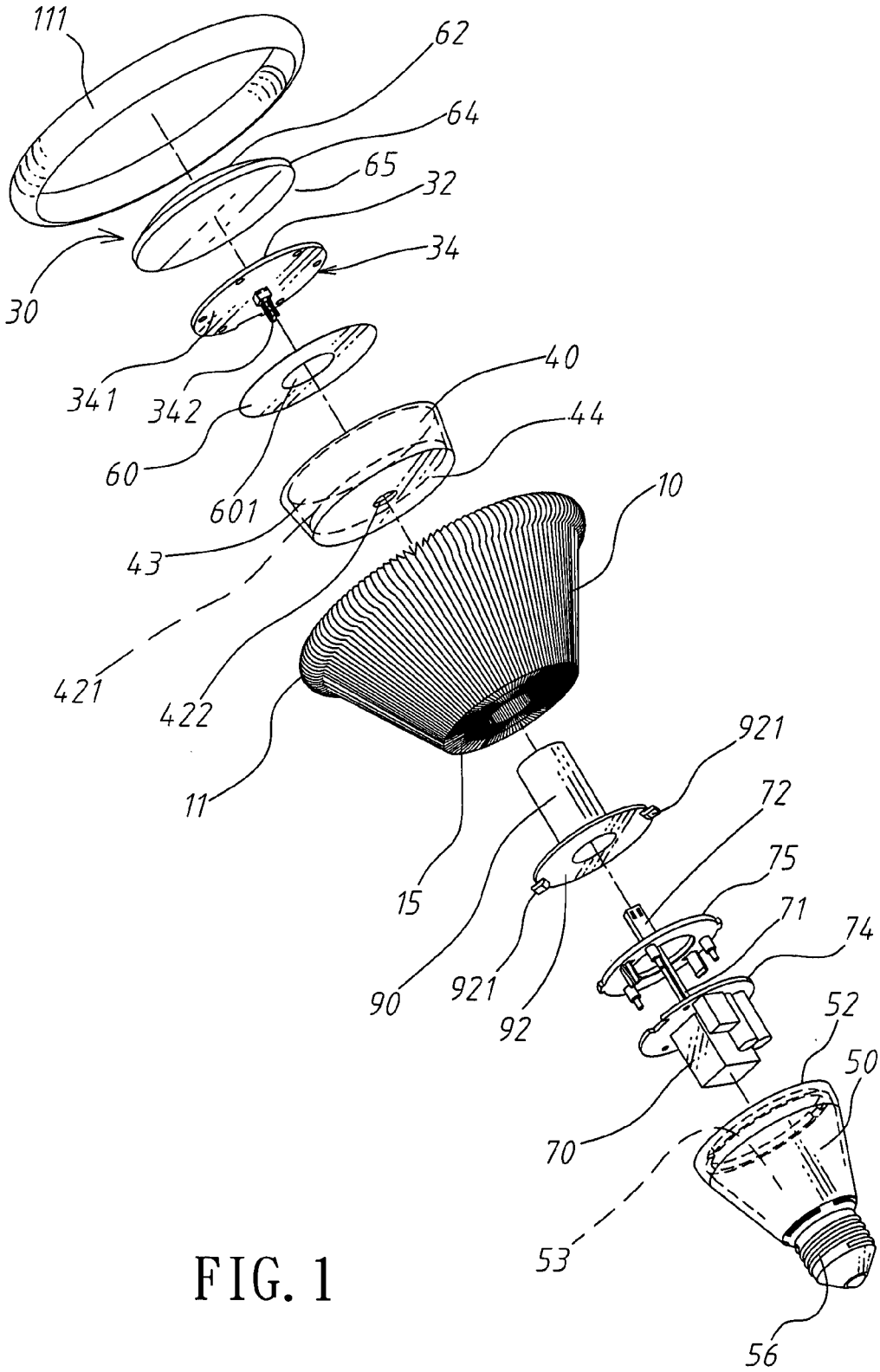
FIG. 1 shows an exploded elevational view depicting component members of the present invention.
Figure 2:
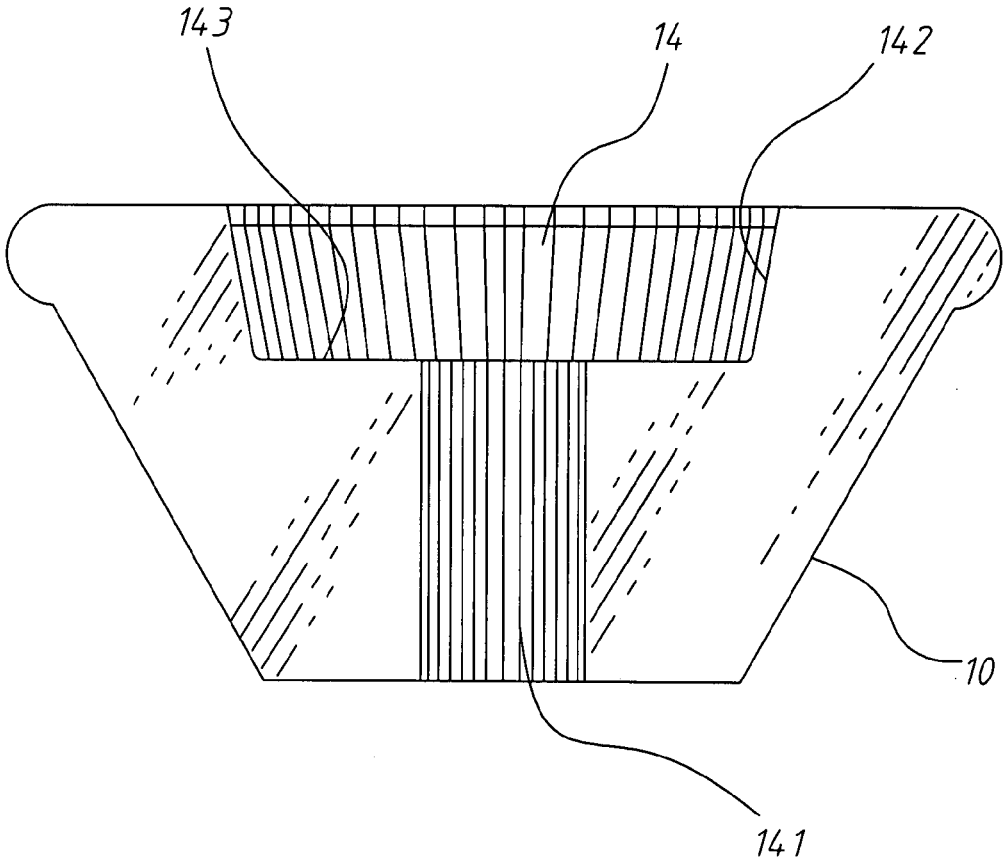
FIG. 2 shows a cross sectional view of a heat dissipating unit according to the present invention.
Figure 3:
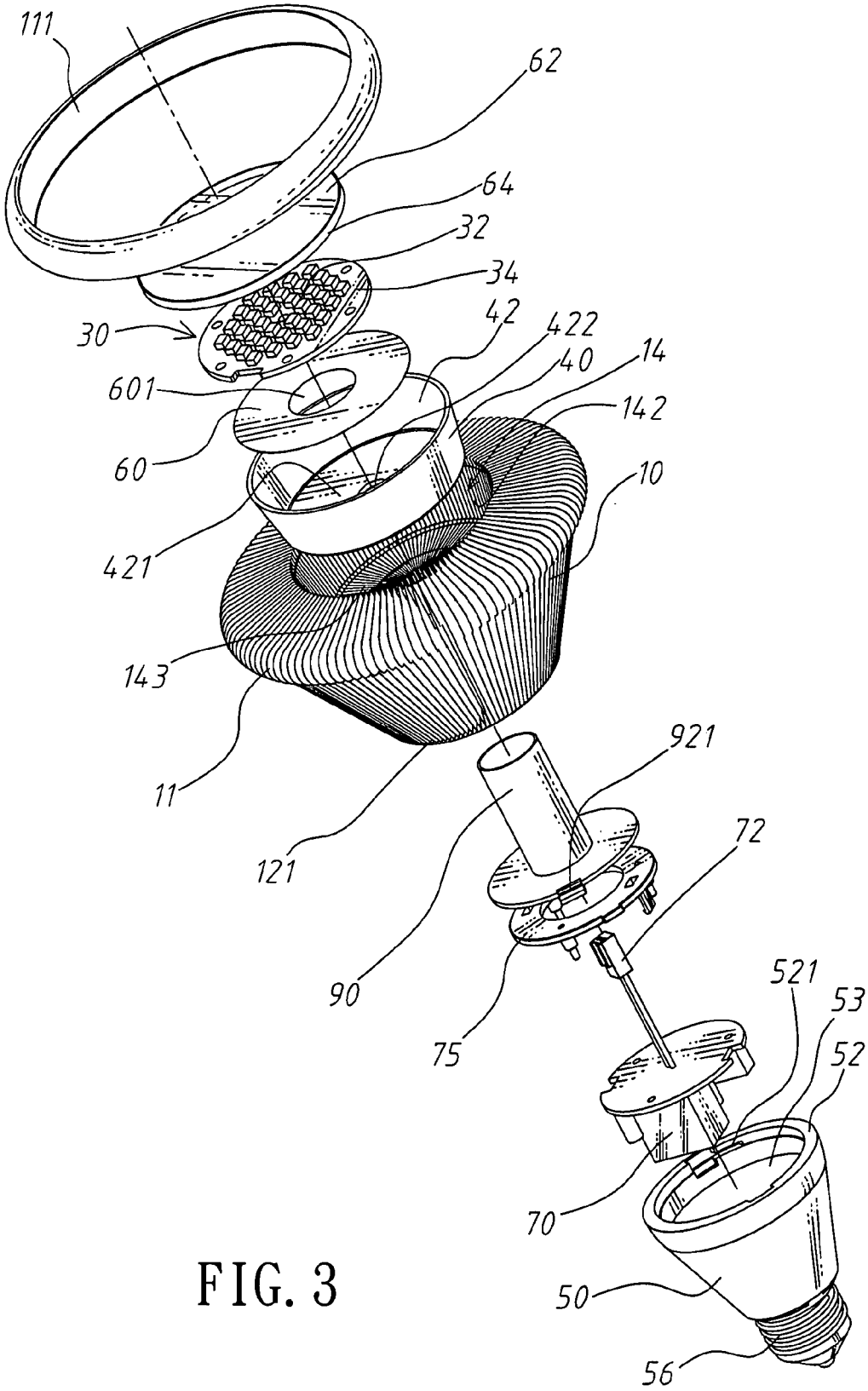
FIG. 3 shows another exploded elevational view depicting the component members of the present invention.
Figure 4:
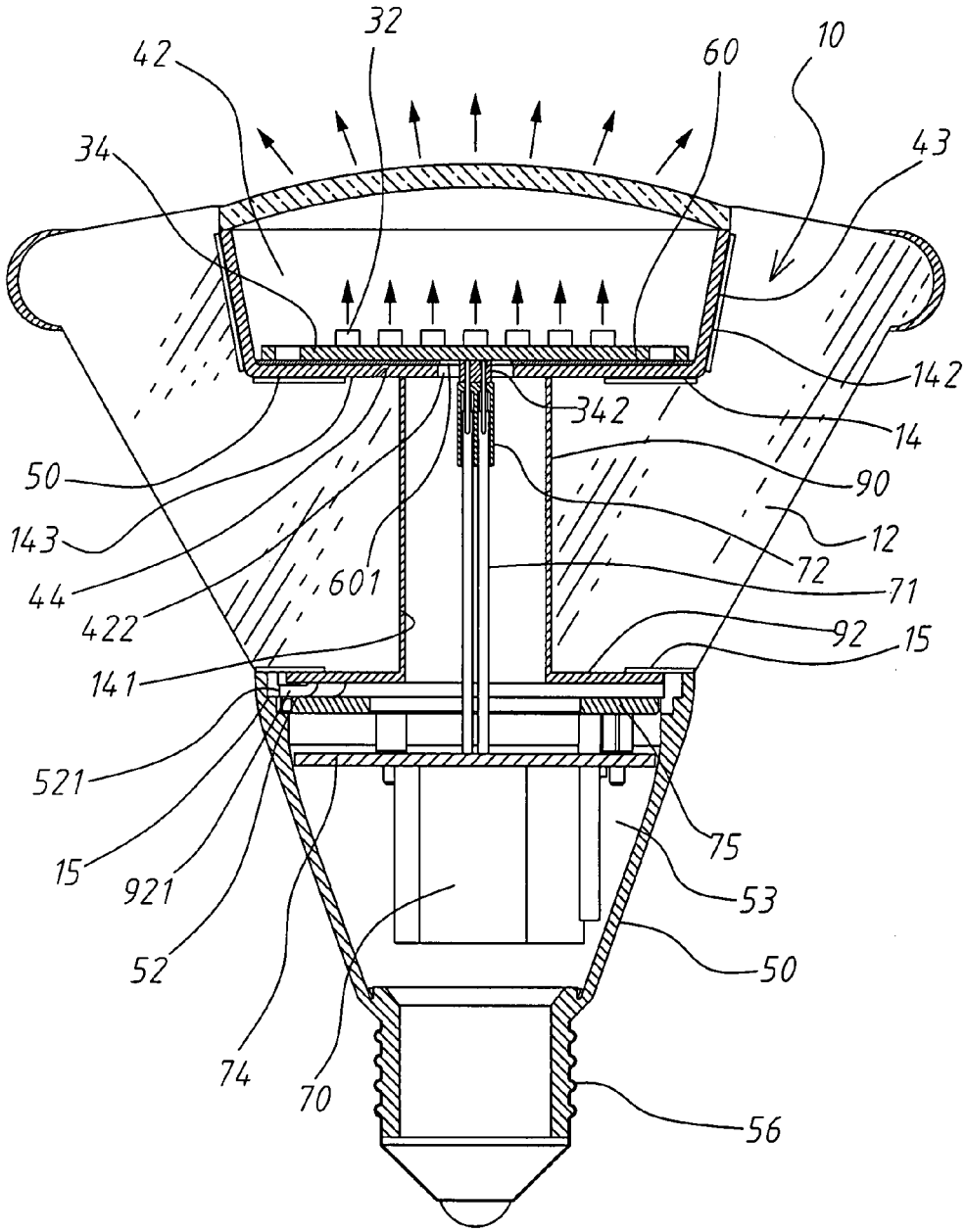
FIG. 4 shows a longitudinal cross sectional view of the present invention.

Referring to FIGS. 1, 2 and 3, which show the heat dissipating device for LED light-emitting module of the present invention, comprising: a plurality of fins 12 configured in a radial arrangement, a composite mutual soldering of which forms a heat dissipating unit 10. A cavity 14 enabling soldering thereto is configured center of the heat dissipating unit 10, and a through hole 141 is defined center of the cavity 14. A cavity side wall 142 of the cavity 14 forms a linear side wall, and a bottom portion of the cavity 14 forms a linear cavity wall 143, wherein linearity refers to the rectilinear form of the sides of the walls formed by the plurality of fins 12. An LED light-emitting module 30 (as depicted in FIG. 3) comprises at least more than one light-emitting crystal 32 connected to a baseplate 34. A heat dissipating base 40 is provided with a holding space 42, and a heat conducting layer 60 is packed and joined to a bottom surface 421 of the holding space 42. A bottom surface 341 of the baseplate 34 is packed and joined to a surface of the heat conducting layer 60 (as depicted in FIG. 1). An outer surface 44 of a bottom portion of the heat dissipating base 40 is soldered to the linear horizontal cavity wall 143, and an outer peripheral surface 43 of the heat dissipating base 40 is soldered to the linear cavity side wall 142 (as depicted in FIG. 4).

An outer surface of the heat dissipating unit 10 assumes a conical form, and an outer annular member 111 is joined to a peripheral edge 11 of the greatest outer diameter of the heat dissipating unit 10, A lens 65 is fitted to an upper portion of the baseplate 34, and the lens 65 is configured with a convex shaped or concave shaped surface 62. A peripheral edge 64 of the lens 65 is disposed within a peripheral groove of the cavity 14. The cavity side wall 142 of the cavity 14 is inclined to form a conical form, and the outer peripheral surface 43 of the heat dissipating base 40 assumes a conical form, The outer peripheral surface 43 is soldered to the cavity side wall 142 (as depicted in FIG. 4).

A through hole 422 is defined center of a bottom portion of the heat dissipating base 40.

A through hole 601 is defined center of the heat conducting layer 60, and the two through holes 422, 601 mutually correspond, thereby enabling an electric connector 342 of the baseplate 34 to pass through the through holes 601, 422.

A power supply 70 is disposed within a holding cavity 53 interior of a lamp base 50, and an electrical conducting wire 71 of the power supply 70 externally connects to a connector 72. The connector 72 plugs into the connector 342 of the baseplate 34.

A bottom end of a sleeve 90 is joined to a base plate 92, and the sleeve 90 penetrates the through hole 141 of the heat dissipating unit 10. Clasp protruding pieces 921 are respectively located on two sides of the base plate 92, and a fixed disk 75 is fixedly joined to an upper plate 74. The clasp protruding pieces 921 of the base plate 92 are clasped within annular grooves 521 predefined in a lower edge of an open end 52 of the lamp base 50 (as depicted in FIG. 3).

A bottom connecting portion 15 of a horizontal cross section of a lower end of the heat dissipating unit 10 is fixedly joined to a surface of the base plate 92 (as depicted in FIG. 4).

The baseplate 34 depicted in FIG. 1 can be fabricated from aluminum, copper, quartz or ceramic material.

The heat conducting layer 60 depicted in FIG. 1 can use carbon fiber powder 66 material.

Referring to FIG. 1, wherein soldering art is used to solder an outer surface 44 of a bottom portion of a heat dissipating base 40 to a horizontal cavity wall 143, thereby enabling the heat dissipating base 40 to make a firm contact and connection with the horizontal cavity wall 143 (as depicted in FIG. 4). An outer peripheral surface 43 of the heat dissipating base 40 is soldered to a linear cavity side wall 142, thereby joining the heat dissipating base 40 to the linear cavity side wall 142, and joining the entire heat dissipating base 40 within a cavity 14. Accordingly, the heat dissipating base 40 is able to effectively transmit heat to a plurality of fins 12, thereby providing reliable and improved heat dissipation effectiveness.

A heat conducting layer 60 can be a solid state piece or gel form, and adhesion of the heat conducting layer 60 is used to attach to a bottom surface 341 of a baseplate 34 and be fixed to a bottom surface 421 of a holding space 42 (as depicted in FIG. 1). The baseplate 34 is manufactured from quartz material, and because "quartz" is provided with high heat conducting characteristics, thus, heat dissipation efficiency of the entire baseplate 34 is increased. The heat conducting layer 60 has carbon fiber powder 66 material added thereto, which enables heat from the baseplate 34 to be uniformly conducted to the heat dissipating base 40. Because the heat conducting layer 60 is uniformly adhered to the bottom surfaces 341, 421, thus, a uniform joining of microscopic pores, machining tool marks and flatness leveling of the bottom surfaces 341, 421 is able to be effected with the heat conducting layer 60, thereby increasing heat dissipation efficiency. When diode 32 are subjected to an electrical effect and are emitting light, then the high heat produced is quickly directly transmitted to the heat dissipating base 40 through the heat conducting layer 60, whereupon the heat dissipating unit 40 further transmits the heat to a heat dissipating unit 10, where the heat is dissipated. Hence, high temperature of the diode 32 produced when emitting light is quickly dissipated, thereby extending serviceable life of the diode 32.

Figure 5:
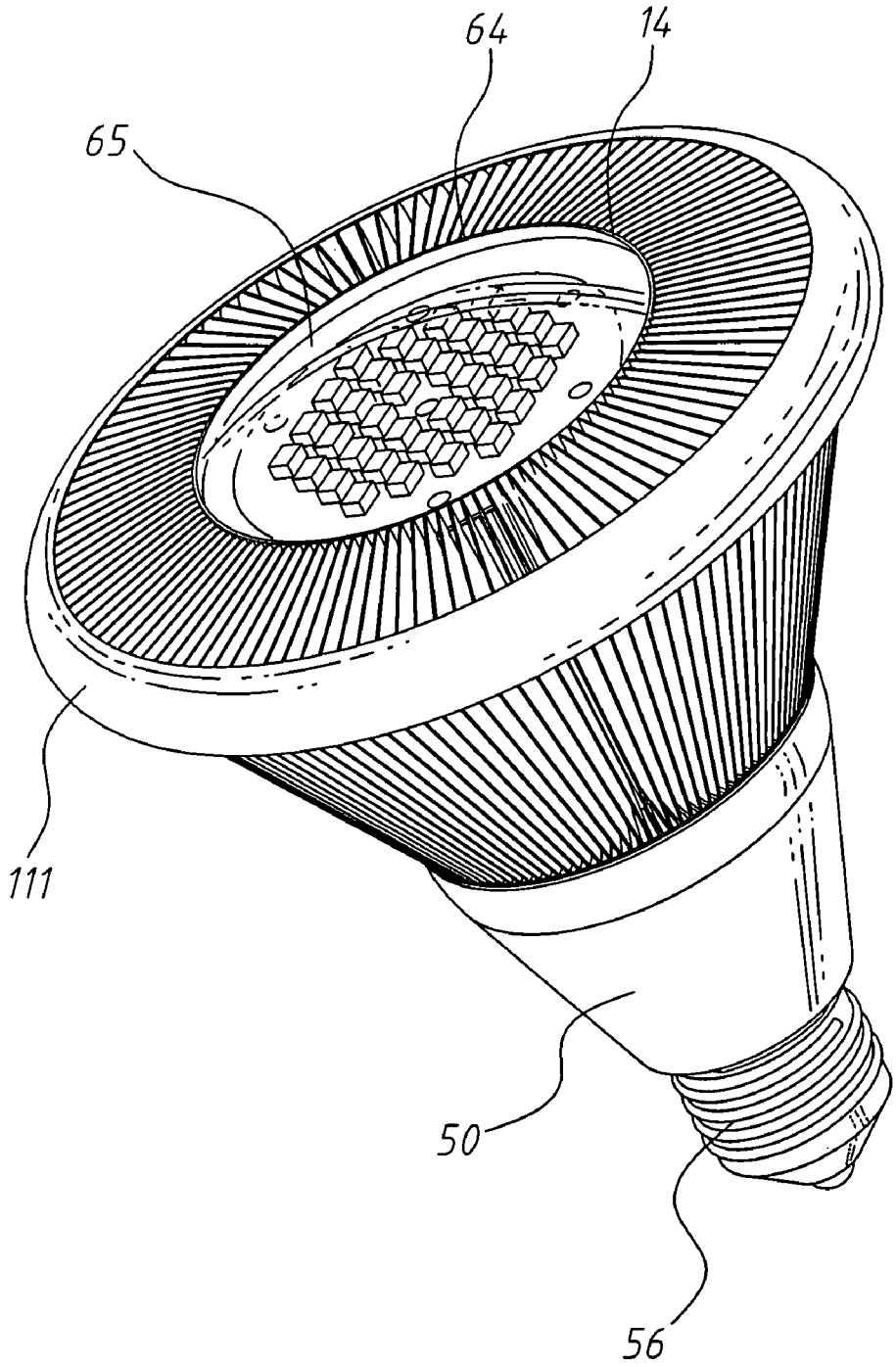
FIG. 5 shows an elevational view of the present invention.

Referring to FIGS. 4 and 5, a lens 65 is configured with a convex shape or concave shape, thereby focusing or defocusing the light spectrum emitted by the diode 32 so as to enable adjusting the angle of the LED light-emitting spectrum, and adjust luminance and softness of the light, and thus providing the user with choice of use. An outer annular member 111 is clasped to a peripheral edge 11 of the heat dissipating unit 10, which further fixedly secures the heat dissipating unit 10. Should the heat dissipating unit 10 be subjected to an external force or impact, then protection by the outer annular member 111 prevents deformation of the fins 12.

A connector 72 passes through a through hole of a sleeve 90, and connects with another connector 342, thereby enabling a quick and convenient electric connection therebetween. Moreover, the electrical connection between the two connectors 342, 72 is provided with directional connection, which is able to prevent misapplication by users reverse connecting the connectors 342, 72

A screw connection 56 at a rear end of a lamp base 50 is screw connected to an outside electric outlet (not shown in the drawings), and after the acquired power source has passed through a power supply 70 and undergone rectification/voltage transformation, output of an appropriate voltage/electric current is supplied to the baseplate 34 and the diode 32 through the connectors 342, 72 for use thereof.

Referring to FIGS. 4 and 5, an upper plate 74, the power supply 70, a fixed disk 75 and a base plate 92 are fixed within a holding cavity 53, and the sleeve 90 penetrates a through hole 141. Clasp protruding pieces 921 are rotated and clasped within annular grooves 521 slightly below an open end 52 (see FIGS. 1 and 4), thereby enabling the base plate 92 and the sleeve 90 to be fixed within the lamp base 50. A horizontal cross section of a bottom portion of the heat dissipating unit 10 serves as a bottom connecting portion 15, which is soldered and fixedly joined to the surface of the base plate 92 to form an integrated body, Accordingly, once the base plate 92 has been firmly fixed to the lamp base 50, then the heat dissipating unit 10 has at the same time been fixed to the lamp base 50. Hence, because the heat dissipating base 40 is fixed within the cavity 14 of the heat dissipating unit 10, and at the same time the heat dissipating unit 10 is firmly fixed to the lamp base 50, thus, the heat dissipating unit 10 will not easily become loose or come apart when subjected to external forces.

Figure 6:
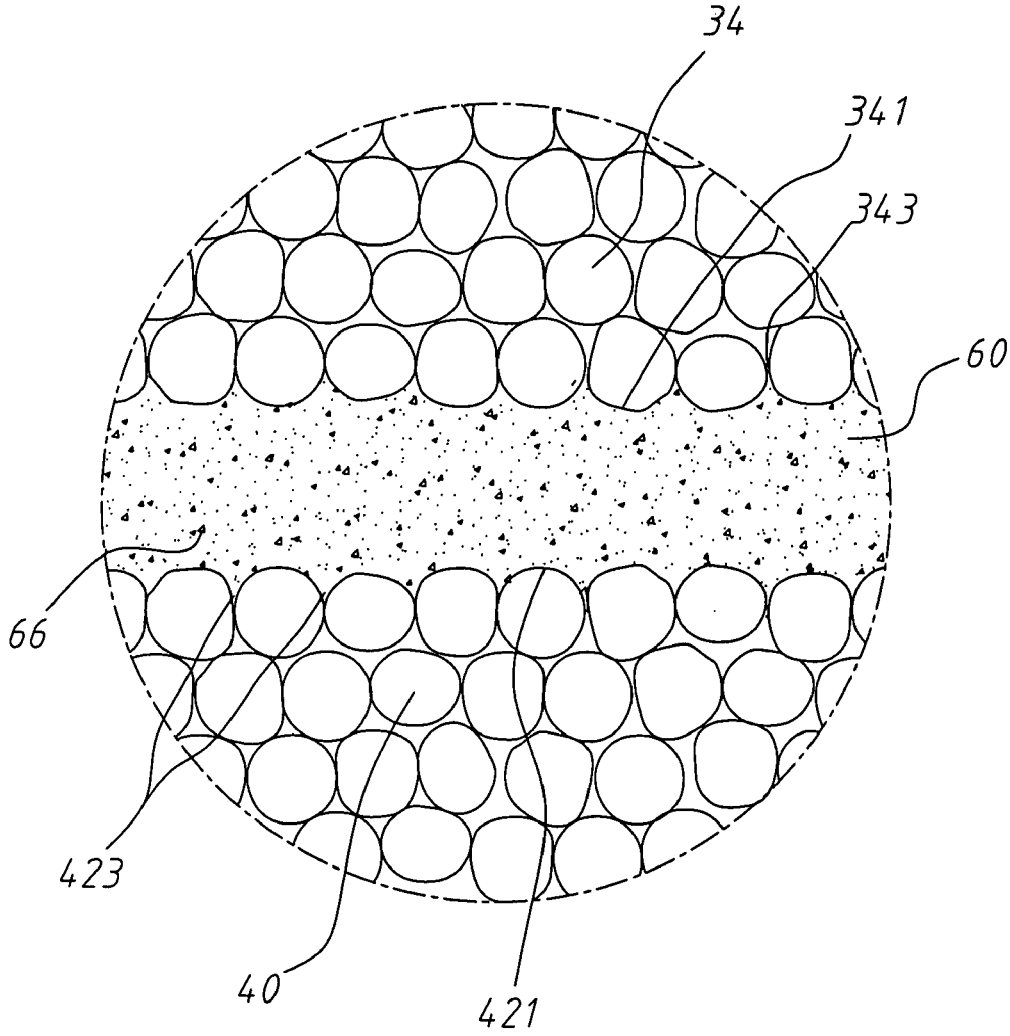
FIG. 6 shows a partial enlarged view depicting joining of a baseplate and a heat dissipating base using a heat conducting layer of the present invention.

Referring to FIG. 6, carbon fiber powder 66 can be chosen as the material for the heat conducting layer 60, and each molecule of the carbon fiber powder 66 manufactured using a nanometer manufacturing process is $10^{-6}$ mm in size. Microscopic inspection of the bottom surface 341 of the baseplate 34 reveals uneven pores 343, and microscopic inspection of the bottom surface 421 of the heat dissipating base 40 reveals uneven pores 423. The nanometered carbon fiber powder 66 particles can effectively fill the pores 423, 343, machining tool marks and flatness leveling, thereby achieving increasing high heat conduction efficiency.

Figure 7:
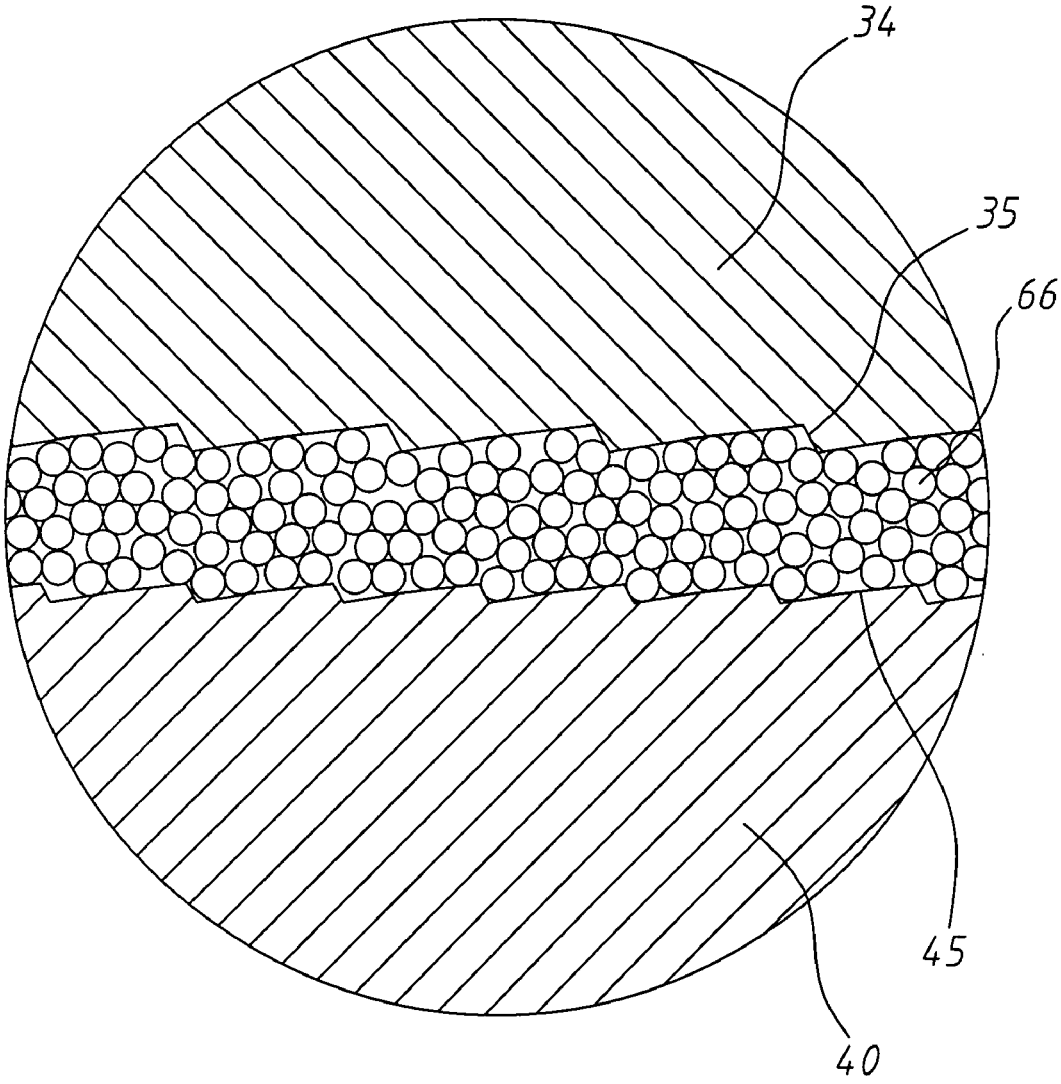
FIG. 7 shows another partial enlarged view depicting joining of the baseplate and the heat dissipating base using a heat conducting layer of the present invention.

Referring to FIG. 7, if the baseplate 34 and the heat dissipating base 40 have undergone machining through the use of machine tools, for example, machining through the use of milling cutters and planing tools, then, microscopic inspection of the machined surfaces reveals uneven tool marked surfaces 35, 45, or the existence of a non-horizontal plane machined surface. However, packing the heat conducting layer 60 into the gap between the tool marked surfaces 35, 45 enables the carbon fiber powder 66 to completely fill the gap between the uneven tool marked surfaces 35, 45, thereby further increasing heat conduction effectiveness of the baseplate 34 and the heat dissipating base 40.

In conclusion, effectiveness of the characteristics of the present invention has been singularly achieved, thus providing the present invention with originality and advancement. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A heat dissipating device for LED light-emitting module comprising:

a plurality of fins configured in a radial arrangement, a composite mutual soldering of which forms a heat dissipating unit; a cavity enabling soldering thereto is configured center of the heat dissipating unit, and a through hole is defined center of the cavity, a cavity side wall of the cavity forms a linear side wall, and a bottom portion of the cavity forms a linear cavity wall;

an LED light-emitting module, comprising:

at least one or more than one light-emitting crystal connected to a baseplate; a heat dissipating base is provided with a holding space, and a heat conducting layer is packed into a connecting gap between a bottom surface of the holding space and a bottom surface of the baseplate and joined thereto, an outer surface of a bottom portion of the heat dissipating base is soldered to the linear horizontal cavity wall, and an outer peripheral surface of the heat dissipating base is soldered to the linear cavity side wall.

2. The heat dissipating device for LED light-emitting module according to claim 1, wherein a lens is fitted to an upper portion of the baseplate, and the lens is configured with a convex shaped or concave shaped surface; a peripheral edge of the lens is disposed within a peripheral groove of the cavity;

the cavity side wall of the cavity is inclined to form a conical form;

the outer peripheral surface of the heat dissipating base assumes a conical form, and the outer peripheral surface is soldered to the cavity side wall.

3. The heat dissipating device for LED light-emitting module according to claim 1, wherein a through hole is defined center of a bottom portion of the heat dissipating base;

a through hole is defined center of the heat conducting layer, and the two through holes mutually correspond, thereby enabling an electric connector of the baseplate to pass through the through holes;

a power supply is disposed within a holding cavity interior of a lamp base, and an electrical conducting wire of the power supply externally connects to a connector, which plugs into the connector of the baseplate.

4. The heat dissipating device for LED light-emitting module according to claim 1, wherein a bottom end of a sleeve is joined to a base plate, and the sleeve penetrates the through hole of the heat dissipating unit;

clasp protruding pieces are respectively located on two sides of the base plate;

a fixed disk is fixedly joined to an upper plate;

the clasp protruding pieces of the base plate are clasped within annular grooves predefined in a lower edge of an open end of the lamp base;

a bottom connecting portion of a horizontal cross section of a lower end of the heat dissipating unit is fixedly joined to a surface of the base plate.

5. The heat dissipating device for LED light-emitting module according to claim 1, wherein the baseplate is fabricated from aluminum, copper, quartz or ceramic material.

6. The heat dissipating device for LED light-emitting module according to claim 1, wherein the heat conducting layer uses carbon fiber powder material; and the nanometered carbon fiber powder material fills the pores of the bottom surface of the heat dissipating base and the pores of the bottom surface of the baseplate.

7. The heat dissipating device for LED light-emitting module according to claim 1, wherein the heat conducting layer is a semisolid gel form or paste.

8. The heat dissipating device for LED light-emitting module according to claim 1, wherein an outer surface of the heat dissipating unit assumes a conical form, and an outer annular member is joined to a peripheral edge of the greatest outer diameter of the heat dissipating unit.

* * * * *